US009698464B2

(12) United States Patent
Fukui et al.

(10) Patent No.: US 9,698,464 B2
(45) Date of Patent: Jul. 4, 2017

(54) TRANSMISSION LINE AND ELECTRONIC COMPONENT

(71) Applicant: TDK CORPORATION, Tokyo (JP)

(72) Inventors: Takashi Fukui, Tokyo (JP); Kiyoshi Hatanaka, Tokyo (JP); Toshio Sakurai, Tokyo (JP); Shigemitsu Tomaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 103 days.

(21) Appl. No.: 14/789,261

(22) Filed: Jul. 1, 2015

(65) Prior Publication Data

US 2016/0013535 A1 Jan. 14, 2016

(30) Foreign Application Priority Data

Jul. 8, 2014 (JP) ..... 2014-140289
Dec. 9, 2014 (JP) ..... 2014-248807

(51) Int. Cl.
*H01P 7/00* (2006.01)
*H01P 7/10* (2006.01)

(52) U.S. Cl.
CPC ..... *H01P 7/10* (2013.01)

(58) Field of Classification Search
CPC ..... H03H 5/00; H03H 5/006; H03H 7/0115; H01F 27/327
USPC ..... 333/185, 182, 219, 222, 204, 205, 202, 333/207
See application file for complete search history.

(56) References Cited

U.S. PATENT DOCUMENTS

2004/0189528 A1* 9/2004 Killen ..... H01Q 9/0457 343/700 MS

FOREIGN PATENT DOCUMENTS

| | | |
|---|---|---|
| JP | H04-43703 A | 2/1992 |
| JP | H10-13112 A | 1/1998 |
| JP | 2007-235630 A | 9/2007 |

* cited by examiner

*Primary Examiner* — Robert Pascal
*Assistant Examiner* — Kimberly Glenn
(74) *Attorney, Agent, or Firm* — Oliff PLC

(57) ABSTRACT

A transmission line is provided with a line portion with a first relative permittivity which is composed of a first dielectric and a conductor filler dispersed in the first dielectric, and a surrounding dielectric portion composed of a second dielectric with a second relative permittivity, wherein, the surrounding dielectric portion exists around the line portion in a cross section perpendicular to a direction in which electromagnetic waves transmit in the line portion, the first relative permittivity is 600 or more, and the second relative permittivity is smaller than the first relative permittivity. An electronic component has the transmission line. Further, an electronic component is provided with a resonator having a resonant frequency ranging from 1 GHz to 10 GHz, wherein, the resonator is formed by using the transmission line.

20 Claims, 3 Drawing Sheets

TRANSMISSION LINE AND ELECTRONIC COMPONENT

The present invention relates to a microwave transmission line which forms a resonator at a frequency band of 10 GHz or less. The present invention also relates to an electronic component.

BACKGROUND

In a short range wireless communication or a mobile communication, a microwave band is usually used, particularly the frequency band ranging from 1 GHz to 10 GHz. The communication devices used in these communications are strongly demanded to be downsized and thinned. Also, the electronic component used in the communication devices are also strongly demanded to be downsized and thinned.

Generally, when a signal of a high frequency within a frequency band ranging from 1 GHz to 10 GHz is transmitted, a transmission line configured by combining a conductor and a dielectric is used such as a coaxial line, a strip line, a microstrip a coplanar line or other lines The electronic component used in the communication devices contains a component containing a resonator such as a band pass filter. Such a resonator has a component using a distributed constant line or using an inductor together with a capacitor, any of which contains a transmission line. In the resonator, the unloaded Q value is required to be relatively high. Meanwhile, the unloaded Q value can be increased in the resonator by decreasing the loss in the resonator.

The loss in the transmission line includes the dielectric loss, the conductor loss and the radiation loss. The higher the signal frequency is, the more evident the skin effect becomes. Also, the conduct loss will significantly increase. Most of the loss in the resonator derives from the conduct loss. Thus, in order to increase the unloaded Q value in the resonator, it will be effective to decrease the conduct loss. The techniques described in Patent Document 1 and Patent Document 2 are known as the technique for increasing the unloaded Q value in the resonator by decreasing the conductor loss.

A technique has been described in Patent Document 1. In particular, in a resonator with symmetric strip lines, a plurality of strip conductor electrodes are disposed between a pair of ground conductors. In particular, the electrodes are disposed in such a manner that a dielectric is interposed between the plurality of conductors and these electrodes are disposed to be parallel to the ground conductors. Based on this, the conductor loss in the electrodes made of strip conductors is decreased and the unloaded Q value in the resonator is increased.

Patent Document 2 has disclosed a technique. In particular, in a resonator containing strip line electrodes, the strip line electrodes are used as a multilayered electrode containing a multilayered portion and a conductor, wherein the multilayered portion is formed by alternatively stacking a dielectric layer and a conductor layer. In addition, the surface of each layer forming the multilayered portion is disposed to be perpendicular to the surface of a ground conductor. In this way, the conductor loss in the electrodes made of strip lines is decreased and the unloaded Q value of the resonator is increased.

On the other hand, the dielectric line is known as a transmission line for transmitting the electromagnetic waves at a millimetric wave band of about 50 GHz. For example, a transmission line has been disclosed in Patent Document 3 which is configured by disposing a tape with a high dielectric constant between two conductor plates parallel to each other and also disposing a filling dielectric made of a material with a low dielectric constant between these two parallel conductor plates and the tape with a high dielectric constant. As for this transmission line, the electric field of the electromagnetic wave is distributed inside the filling dielectric. It has been described in Patent Document 3 that the actually prepared transmission line has a low dispersing property at the frequency band of 30 GHz to 60 GHz.

PATENT DOCUMENT

Patent Document 1: JP-A-H4-43703
Patent Document 2: JP-A-H10-13112
Patent Document 3: JP-A-2007-235630

SUMMARY

As described above, the conventional transmission line for the frequency band of 1 GHz to 10 GHz has a configuration in which a line with an electrode made of a conductor is used. As for such a transmission line, it is difficult to decrease the conductor loss to a great extent even if some strategies are applied as described in Patent Document 1 and Patent Document 2. For example, the surface area of the electrode made of a conductor is increased. In this respect, if the resonator uses this transmission line, the increase of the unloaded Q value is limited.

In another aspect, as described above, the dielectric line is known to transmit the electromagnetic waves at a millimetric wave bad of about 50 GHz. However, the dielectric line is never known for the transmission of the electromagnetic waves at a frequency band of 1 GHz to 10 GHz.

The wave length of an electromagnetic wave is inversely proportional to its frequency. The electromagnetic wave at the frequency band of 1 GHz to 10 GHz will have a wavelength that is 5 to 50 times of the electromagnetic wave at a millimetric wave band of about 50 GHz. In general, as the wave length of the transmitted electromagnetic wave becomes longer, the size of the conventional dielectric line will be bigger. Thus, even if the conventional dielectric line is used to form an electronic component such as a resonator for the frequency band of 1 GHz to 10 GHz, the electronic component will be in a larger size and no applicable electronic component can be obtained.

In addition, the wave length of the electromagnetic wave transmitted in the dielectric line becomes shorter than that of the electromagnetic wave transmitted in the vacuum due to the wavelength-shortening effect produced by the dielectric. However, no great wavelength-shortening effect can be obtained in the conventional dielectric line. For example, it has been described in Patent Document 3 that the relative permittivity of the filling dielectric is, for example, 4 or less. When the relative permittivity becomes 4, then the shortening rate of the wave length is 0.5. In this respect, even if the conventional dielectric line is used, the electronic component cannot be downsized to a great extent through the wavelength-shortening effect of the dielectric.

In view of the problems mentioned above, the present invention aims to provide a transmission line, which is capable of transmitting electromagnetic waves of one or more frequencies ranging from 1 GHz to 10 GHz in an effective way, and an electronic component containing the transmission line.

The transmission line of the present invention is provided with a line portion and a surrounding dielectric portion, wherein the line portion has a first relative permittivity and is composed of a first dielectric and a conductor filler dispersed in the first dielectric, and the surrounding dielectric portion is composed of a second dielectric with a second relative permittivity. In a cross section perpendicular to the direction where the electromagnetic wave is transmitted in the line portion, the surrounding dielectric portion exists around the line portion. The first relative permittivity is 600 or more. The second relative permittivity is smaller than the first relative permittivity. In addition, in the present application, the relative permittivity refers to the real part of the complex relative permittivity. Further, the line portion in the present invention is not limitedly used as one that transmits the electromagnetic waves in only one direction. The line portion can transmit two electromagnetic waves that move in directions opposite to each other such as the travelling wave and the reflected wave.

The relative permittivity of the second dielectric can also be one tenth of the first relative permittivity or even smaller.

The percentage of the conductor filler dispersed in the dielectric of the first dielectric can be 4 to 74 vol % of the total line portion.

The size of the conductor filler dispersed in the first dielectric can be 5 μm or smaller.

In addition, at least part of the surrounding dielectric portion has a relative permeability of 1.02 or more. Further, in the present application, the relative permeability refers to the real part of complex relative permeability.

The electronic component of the present invention contains the transmission line of the present invention. The electronic component of the present invention is provided with a resonator at a resonant frequency of 1 GHz to 10 GHz. This resonator is formed by using the transmission line of the present invention.

In the transmission line and the electronic component of the present invention, the line portion composed the first dielectric and the conductor filler dispersed in that dielectric has a relative permittivity of 600 or more, and the second dielectric forming the surrounding dielectric portion has a relative permittivity that is smaller than that of the first relative permittivity. Based on this, the line portion is capable of effectively transmitting the electromagnetic waves of one or more frequencies ranging from 1 GHz to 10 GHz. Thus, an effect is realized in the present invention that a transmission line capable of effectively transmitting electromagnetic waves of one or more frequencies ranging from 1 GHz to 10 GHz is carried out as well as an electronic component containing this transmission line.

DETAILED DESCRIPTION OF EMBODIMENTS

First Embodiment

Figure 1:
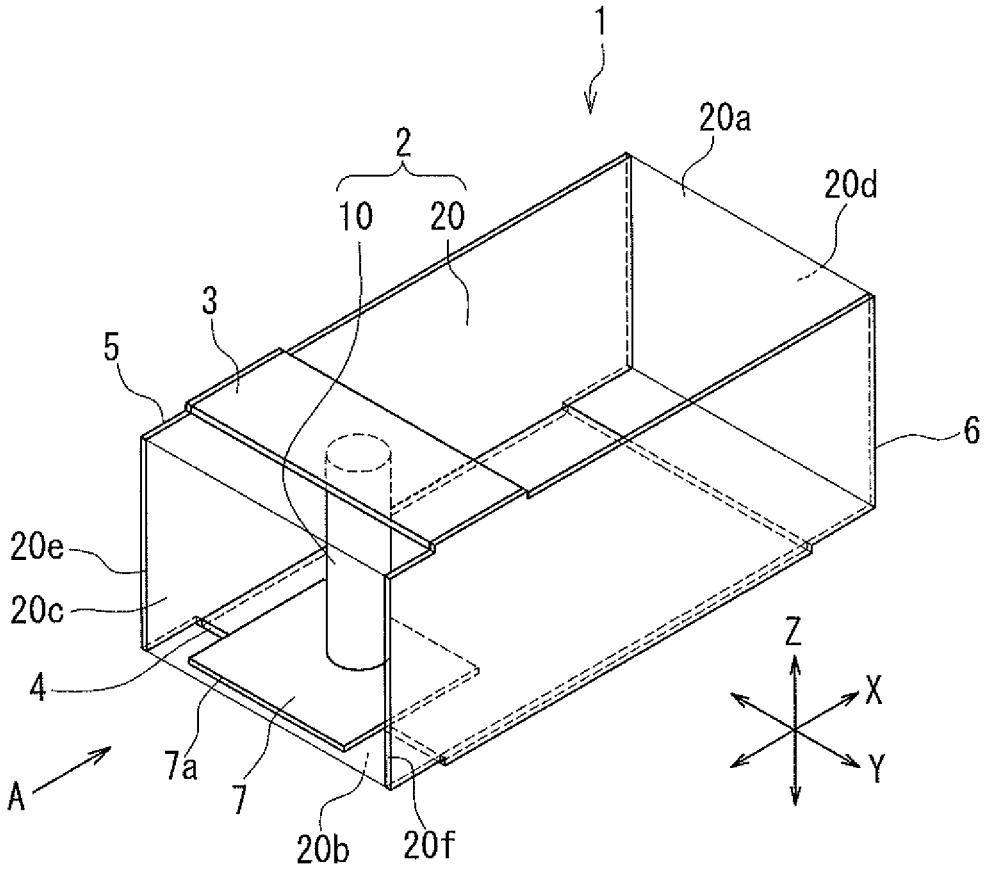
FIG. 1 is a stereogram showing the transmission line and the electronic component in the embodiment of the present invention.
Figure 2:
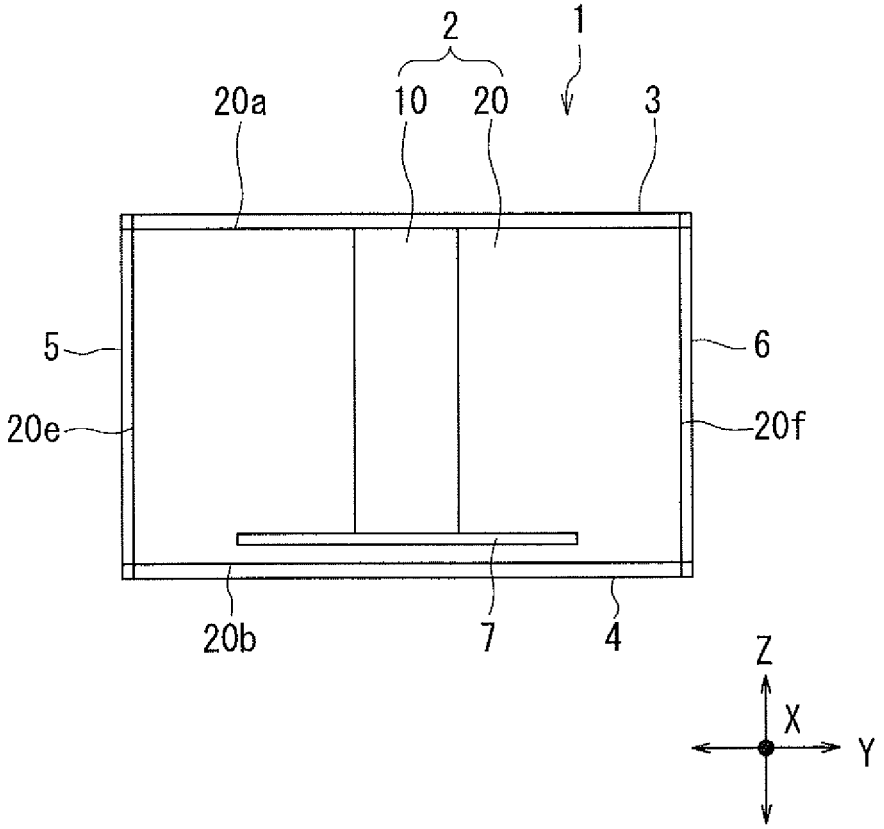
FIG. 2 is a side view showing the electronic component in FIG. 1 when viewed in the A direction.
Figure 3:
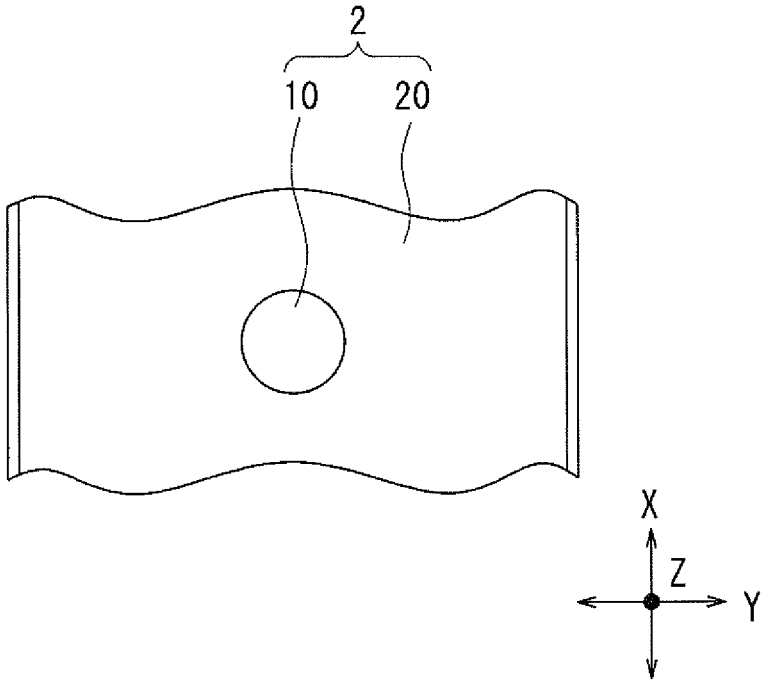
FIG. 3 is a cross sectional view showing the cross section of the transmission line in FIG. 1.

Hereinafter, the embodiments of the present invention will be described with reference to the drawings. Firstly, the configurations of the transmission line and the electronic component in the first embodiment of the present invention will be described with reference to FIG. 1 to FIG. 3. FIG. 1 is a stereogram showing the transmission line and the electronic component of the present embodiment. FIG. 2 is a side view showing the electronic component in FIG. 1 when viewed in the A direction. FIG. 3 is a cross sectional view showing the cross section of the transmission line shown in FIG. 1.

As shown in FIG. 1 to FIG. 3, an electronic component 1 of the present embodiment contains a transmission line 2 of the present embodiment. The transmission line 2 is provided with a line portion 10 and a surrounding dielectric portion 20, wherein the line portion 10 has a first relative permittivity and is composed a first dielectric and a conductor filler dispersed in the first dielectric, and the surrounding dielectric portion 20 is composed of a second dielectric with a second relative permittivity E2. The line portion 10 transmits the electromagnetic waves of one or more frequencies ranging from 1 GHz to 10 GHz. The surrounding dielectric portion 20 exists around the line portion 10 in a cross section perpendicular to the direction in which the electromagnetic waves transmit in the line portion 10. Particularly, in the present embodiment, the surrounding portion 20 connects to the periphery of the line portion 10 in the cross section mentioned above. The first relative permittivity E1 of the line portion 10 is 600 or more. The second relative permittivity E2 is smaller than the first relative permittivity E1.

In the present embodiment, the line portion 10 has a cylindrical shape. The direction in which the electromagnetic waves transmit in the line portion 10 is the direction of the central axis of the cylinder. The surrounding dielectric portion 20 is cubic. In the cross section perpendicular to the direction in which the electromagnetic waves transmit in the line portion 10, the line portion 10 is circular and the surrounding dielectric portion 20 is rectangular. Here, as shown in FIG. 1, the direction parallel to the longer side of the rectangle which represents the shape of the surrounding dielectric portion 20 in the cross section mentioned above is defined as the X direction, and the direction parallel to the shorter side of that rectangle is defined as the Y direction. In addition, the direction in which the electromagnetic waves are transmitted in the line portion 10 (the direction of the central axis of the cylinder which represents the shape of the line portion 10) is defined as the Z direction. The X direction, the Y direction and the Z direction are perpendicular to each other. FIG. 3 shows the cross section perpendicular to the Z direction which is also the direction in which the electromagnetic waves transmits in the line portion 10.

The surrounding dielectric portion 20 has an upper surface 20 a and a lower surface 20*b* which two are located on both ends in the Z direction, two side surfaces 20*c* and 20*d* which two are located on both ends in the X direction, and two side surfaces 20*e* and 20*f* which two are located on both ends in the Y direction.

The electronic component 1 further contains conductor layers 3, 4, 5 and 6 respectively disposed on the upper surface 20*a*, the lower surface 20*b*, the side surface 20*e* and the side surface 20*f* of the surrounding dielectric portion 20. The length of the conductor layer 3 in the X direction is shorter than that of the upper surface 20*a* also in the X direction. The length of the conductor layer 3 in the Y direction is equal to that of the upper surface 20*a* also in the Y direction. The conductor layer 3 only covers part of the upper surface 20*a*. The length of the conductor layer 4 in the X direction is shorter than that of the lower surface 20*b* also in the X direction. The length of the conductor layer 4 in the Y direction is equal to that of the lower surface 20*b* also in the Y direction. The conductor layer 4 only covers part of the lower surface 20*b*. The conductor layer 5 covers the whole side surface 20*e* and is electrically connected to the conductor layers 3 and 4. The conductor layer 6 covers the whole side surface 20*f* and is electrically connected to the conductor layers 3 and 4. Further, the conductor layers 3, 4, 5 and 6 are connected to the ground.

The electronic component 1 is further provided with a conductor layer 7 disposed inside the surrounding dielectric portion 20 and opposite to the conductor layer 4 with a specified gap interposed therebetween. In addition, part of the surrounding dielectric portion 20 lies between the conductor layer 4 and the conductor layer 7.

One end of the line portion 10 in the Z direction is connected to the conductor layer 7. The conductor layer 7 has an end portion 7*a* protruding from the side surface 20*c* of the surrounding dielectric portion 20. The other end of the line portion 10 in the Z direction is connected to the conductor layer 3.

Figure 4:
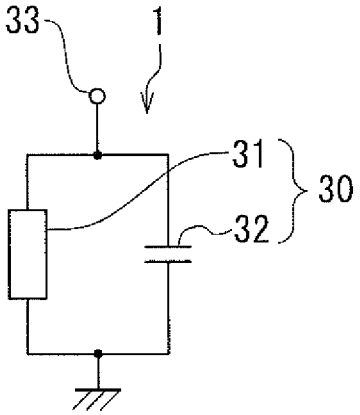
FIG. 4 is a circuit diagram showing the circuit configuration of the electronic component in FIG. 1.

Next, the circuit configuration of the electronic component 1 of the present embodiment will be described with reference to the circuit diagram shown in FIG. 4. The electronic component 1 of the present embodiment is provided with a resonator 30 and an input/output terminal 33, wherein the resonator 30 has an inductor 31 and a capacitor 32 connected in parallel. One end of the inductor 31 and one end of the capacitor 32 are electrically connected to the input/output terminal 33. The other end of the inductor 31 and the other end of the capacitor 32 are electrically connected to the ground. Further, the inductor 31 and the capacitor 32 form a parallel resonant circuit. The resonator 30 provides a resonant frequency ranging from 1 GHz to 10 GHz.

The resonator 30 is formed by using the transmission line 2. In particular, the inductor 31 forming the resonator 30 is configured by using the line portion 10 in the transmission line 2. In addition, the capacitor 32 is formed by the conductor layers 4 and 7 and part of the surrounding dielectric portion 20 sandwiched between these two conductor layers as shown in FIG. 1. The input/output terminal 33 is composed of the end portion 7*a* of the conductor layer 7 as shown in FIG. 1. Further, a conductor layer coupled to the end portion 7*a* of the conductor layer 7 is disposed on the side surface 20*c* of the surrounding dielectric portion 20. This conductor layer can function as the input/output terminal 33.

Next, the functions of the transmission line 2 and the electronic component 1 in the present embodiment will be described. A electric power of any frequency selected from the frequency ranging from 1 GHz to 10 GHz will be supplied to the input/output terminal 33 formed by the end portion 7*a* of the conductor layer 7. With the electric power, an electromagnetic wave is excited in the line portion 10 connected to the conductor layer 7. The line portion 10 transmits the electromagnetic wave of one or more frequencies ranging from 1 GHz to 10 GHz. The resonant frequency of the resonator 30 is included in the one or more frequencies of the electromagnetic wave transmitted by the line portion 10. The resonator 30 resonates at a resonant frequency ranging from 1 GHz to 10 GHz. The voltage at the input/output terminal 30 turns to the maximum value when the frequency of the electric power supplied to the input/output terminal 33 is the same with the resonant frequency. On the other hand, it will decrease accordingly when the frequency of the electric power supplied to the input/output terminal 33 deviates away from the resonant frequency.

In the present embodiment, in the line portion 10 composed of the first dielectric and the conductor filler dispersed in the first dielectric, the relative permittivity E1 is 600 or more. In the meanwhile, the second relative permittivity E2 of the second dielectric forming the surrounding dielectric portion 20 is smaller than the relative permittivity E1 of the line portion 10. In the line portion 10, when the conductor filler is dispersed in the dielectric, the relative permittivity E1 can be increased compared to that of the first dielectric. Also, the loss in the transmission line can be inhibited and the electromagnetic waves can be effectively transmitted. Compared to the relative permittivity of the dielectric used in a conventional dielectric line which transmits the electromagnetic waves of a millimetric wave band of about 50 GHz, the value of the relative permittivity E1 of 600 or more in the line portion 10 is extremely large. As the value of the relative permittivity E1 in the line portion is set as such a large value, the line portion 10 can effectively transmit the electromagnetic waves of one or more frequencies ranging from 1 GHz to 10 GHz. In addition, the material of the first dielectric is not necessarily limited, and the preferable examples are $SrTiO_3$, $CaTiO_3$, $BaTiO_3$ and the combination of two or more of them. Further, the upper limit of the relative permittivity E1 of the line portion 10 is not particularly limited. As the inhibitory effect on the loss in the transmission line is predicted to be substantially constant when E1 becomes 500,000 or more, the relative permittivity E1 is preferred to be 500,000 or less.

The relative permittivity E1 is increased relative to the relative permittivity of the first dielectric by dispersing the conductor filler in the dielectric in the line portion 10. The principle for this is not clear. However, the main causes may be as follows. In particular, the actual thickness of the dielectric is decreased because of the dispersion of the conductor filler in the dielectric or the complete polarization of the electrons in the conductor filler due to the electric field. In addition, the kind of the metal in the conductor filler is not limited, and Pd, Ag, Cu, Mo, W and the combination of two or more of them are used as the preferable examples.

In the present embodiment, it is preferably that the relative permittivity E2 of the second dielectric in the transmission line 2 is one tenth of the relative permittivity E1 of the line portion 10 or even smaller. When E2 is one tenth of E1 or even smaller, the loss in the transmission line can be inhibited and the electromagnetic waves can be more effectively transmitted. In addition, the lower limit of E2 is not limited, and the relative permittivity E2 is preferred to be 2 or more as it is difficult to use a material with a relative permittivity of 2 or less in actual application. Further, the material for the second dielectric is not necessarily restricted, and $SrTiO_3$, $CaTiO_3$, $Mg_2SiO_4$, polypropylene, Teflon (registered trademark) and the combination of two or more of them can be used as the preferable examples.

In the present embodiment, the percentage occupied by the conductor filler that is dispersed in the first dielectric in the line portion 10 can be 4 to 74 vol % of the total line portion 10. When the percentage is 4% or more, the relative permittivity E1 of the line portion can be greatly increased. Also, the loss in the transmission line 2 is inhibited and the electromagnetic waves can be more effectively transmitted. Similarly, when the percentage is 74 vol % or less, the loss in the transmission line 2 is inhibited and the electromagnetic waves can be more effectively transmitted. As for the percentage occupied by the conductor filler, its percentage by volume can be calculated based on the actual specific gravity measured by Archimedes principle after a sintering process, the theoretic specific gravity of the dielectric portion and the theoretic specific gravity of the metal portion.

In the present embodiment, the conductor filler dispersed in the first dielectric of the line portion has a size of 5 μm or less, more preferably 2 μm or less. When the size is 5 μm or less, the increase of the loss due to the skin effect can be inhibited to the minimum and the electromagnetic waves can be more effectively transmitted. On the other hand, the lower limit of the size is not limited for the conductor filler. As it is hard to uniformly disperse the conductor filler of 0.01 μm or less without agglomerating them in the actual application, the size of the conductor filler is preferably 0.01 μm or more. In addition, the line portion is grind in a planer state to the interior, and then 10 fields of vision which have been magnified 5000 times are observed by a Scanning Electron Microscope (SEM). Then, the size of the conductor filler is obtained based on the average diameter of the conductor portion in the SEM images. Further, the conductor filler can have any shape. For example, it can be spherical, tabular, needle-like or cylindrical.

In the present embodiment, at least part of the surrounding dielectric portion 20 in the transmission line 2 can be formed by a magnetic dielectric (i.e., a dielectric being magnetic). In other words, at least part of the surrounding dielectric portion 20 can has a relative permeability larger than 1. In this case, the relative permeability of at least part of the surrounding dielectric portion 20 (the magnetic dielectric) is preferred to be 1.02 or more. If the surrounding dielectric portion 20 has a relative permeability of 1.02 or more, the electromagnetic waves can be more effectively transmitted. In addition, in the present invention, the relative permeability refers to the real part of the complex relative permeability.

When the surrounding dielectric portion 20 is a magnetic dielectric, the dielectric material forming the second dielectric is not necessarily restricted. The dielectric material being magnetic such as the polypropylene, Teflon (the registered trademark), polyimide, the epoxy resin, the polycycloolefin resin or $CaTiO_3$, $SrTiO_3$, $Mg_2SiO_4$, $Al_2O_3$ and the combination of two or more of them with nickel (Ni), permalloy (Fe—Ni alloy), iron (Fe) and the alloy thereof being dispersed therein can be used.

In another respect, the present invention is not limited to the foregoing embodiments, and various modifications are possible. In addition, the electronic component of the present invention is not limited to one that is provided with a resonator formed by the transmission line of the present invention. It can be one containing the transmission line of the present invention. For example, the electronic component of the present invention can be one provided with a circuit of an antenna, a directional coupler, a matching circuit, a transformer (those other than the resonator) which are all formed by using the transmission line of the present invention.

EXAMPLES

As for the embodiments for carrying out the present invention, the preparation of the material for the transmission line will be described in detail. However, the present invention is not limited to the contents described in the following Examples. In addition, the constituent elements described below includes those easily thought of by one skilled in the art and those substantially the same with the described ones. Further, the constituent elements described below can be appropriately combined together,

Example 1

The powders of $BaTiO_3$, $SrTiO_3$, MnO were weighed with the molar ratio among them being 0.25:0.75:0.002. The powders were mixed with pure water and a commercially available anionic dispersant for 24 hours in a ball mill to provide a mixed slurry. The mixed slurry was heated and dried at 120° C., and then it was cracked by an agate pestle. It crossed through a #300 mesh sieve to be granulated. Thereafter, the resultant substance was put into a crucible made of alumina and calcined at a temperature of 1200 to 1240° C. for 2 hours. In this respect, the material for a first dielectric $(0.25BaO.0.75SrO)TiO_2+0.002MnO)$ was obtained.

The material for the first dielectric was fractioned, and the powder of metal Pd with a particle size of 1 μm was weighed to account 30 vol % of the combined volume of the material for the first dielectric and the Pd powder. The material for the first dielectric and the Pd powder were mixed with ethanol in a ball mill for 24 hours. After the mixed slurry was heated and dried at 80° C. to 120° C. in several stages, it was cracked by an agate pestle and crossed through a #300 mesh sieve to be granulated so as to provide a mixture of the material for the first dielectric and the conductor powder.

Commercially available acryl resin based lacquer solution was added to the mixed powder of the material for the first dielectric and the conductor powder obtained in the method mentioned above in an amount of 8 mass % in terms of the solid content of resins relative to the total mass of the dielectric and the metal. Then, the mixture was mixed in an agate pestle and crossed through a #300 mesh sieve to be granulated. In this way, the granulated powder was obtained. The granulated powder was put into a mold and molded under an increased pressure to provide a formed body sample with a cylindrical shape. After a treatment to remove the binder was done in air at 350° C., the sample was subjected to a thermal treatment at 1400° C. for a certain period of time. In this way, the sintered body of the line portion was obtained which was formed by the first dielectric and the conductor filler dispersed in the dielectric.

In addition, the powders of $MgCO_3$ and $SiO_2$ were weighed with the molar ratio between them being 2:1. The powder was mixed with pure water and a commercially available anionic dispersant for 24 hours in a ball mill to provide a mixed slurry. The mixed slurry was heated and dried at 120° C., and then it was cracked by an agate pestle. It crossed through a #300 mesh sieve to be granulated. Thereafter, the resultant substance was put into a crucible made of alumina and pre-calcined at a temperature of 1200 to 1240° C. for 2 hours. In this way, the forsterite $Mg_2SiO_4$ for forming the second dielectric was obtained.

Example 2

The material for the transmission line was prepared by using the same method as in Example 1 except that the powders of $CaCO_3$ and $TiO_2$ were weighed with the molar ratio between them being 1:1 to provide $CaTiO_3$ as the material for the second dielectric.

Example 3

The material for the transmission line was prepared by using the same method as in Example 1 except that the powders of $CaCO_3$, $SrCO_3$ and $TiO_2$ were weighed with the molar ratio among them being 0.9:0.1:1.0 to provide $(0.9CaO.0.1SrO)TiO_2$ as the material for the second dielectric.

Examples 4 to 14 and Comparative Example 1

The material for the transmission line was prepared by using the same method as in Example 1 except that the powder of metal Pd with a particle size of 1 μm was weighed and mixed with the material for the first dielectric in accordance with the volume ratio shown in Table 1.

the molar ratio among them being 0.45:0.55:0.002 to provide $(0.45BaO.0.55SrO)TiO_2+0.002MnO$ as the material for the first dielectric.

Example 20

The material for the transmission line was prepared by using the same method as in Example 1 except that the powders of $BaTiO_3$, $SrTiO_3$ and MnO were weighed with the molar ratio among them being 0.55:0.45:0.002 to provide $(0.55BaO.0.45SrO)TiO_2+0.002MnO$ as the material for the first dielectric.

TABLE 1

| | Relative permittivity of first dielectric | Percentage by volume of conductor filler in line portion (%) | Size of conductor filler in line portion (μm) | Metallic element in conductor filler of line portion | Relative permittivity E1 of sintered body of line portion | Relative permittivity E2 of second dielectric | Relative permeability of second dielectric (μ') | Resonant frequency when transmission line and electronic component are formed into shapes (GHz) | Unloaded Q value when transmission line and electronic component are formed into shapes | Assessment compared to unloaded Q value 300 when electrode of Ag is used in line portion |
|---|---|---|---|---|---|---|---|---|---|---|
| Comparative Example 1 | 580 | 0 | — | — | 580 | 7 | 1.00 | 12.0 | 290 | X |
| Example 1 | 580 | 30 | 1 | Pd | 1700 | 7 | 1.00 | 6.5 | 400 | ○ |
| Example 2 | 580 | 30 | 1 | Pd | 1700 | 170 | 1.00 | 9.0 | 330 | ○ |
| Example 3 | 580 | 30 | 1 | Pd | 1700 | 180 | 1.00 | 9.5 | 301 | ○ |
| Example 4 | 580 | 1 | 1 | Pd | 600 | 7 | 1.00 | 10.0 | 310 | ○ |
| Example 5 | 580 | 3 | 1 | Pd | 610 | 7 | 1.00 | 9.9 | 310 | ○ |
| Example 6 | 580 | 4 | 1 | Pd | 660 | 7 | 1.00 | 9.5 | 360 | ○ |
| Example 7 | 580 | 10 | 1 | Pd | 800 | 7 | 1.00 | 9.0 | 370 | ○ |
| Example 8 | 580 | 20 | 1 | Pd | 1140 | 7 | 1.00 | 8.0 | 390 | ○ |
| Example 9 | 580 | 40 | 1 | Pd | 2700 | 7 | 1.00 | 5.8 | 410 | ○ |
| Example 10 | 580 | 50 | 1 | Pd | 4700 | 7 | 1.00 | 4.7 | 420 | ○ |
| Example 11 | 580 | 60 | 1 | Pd | 9100 | 7 | 1.00 | 3.7 | 430 | ○ |
| Example 12 | 580 | 74 | 1 | Pd | 33000 | 7 | 1.00 | 2.8 | 450 | ○ |
| Example 13 | 580 | 75 | 1 | Pd | 37000 | 7 | 1.00 | 2.7 | 310 | ○ |
| Example 14 | 580 | 80 | 1 | Pd | 73000 | 7 | 1.00 | 2.6 | 305 | ○ |
| Example 15 | 580 | 30 | 2 | Pd | 1700 | 7 | 1.00 | 6.5 | 380 | ○ |
| Example 16 | 580 | 30 | 4 | Pd | 1700 | 7 | 1.00 | 6.5 | 370 | ○ |
| Example 17 | 580 | 30 | 5 | Pd | 1700 | 7 | 1.00 | 6.5 | 360 | ○ |
| Example 18 | 580 | 30 | 6 | Pd | 1700 | 7 | 1.00 | 6.5 | 310 | ○ |
| Example 19 | 1400 | 30 | 1 | Pd | 4100 | 7 | 1.00 | 5.0 | 420 | ○ |
| Example 20 | 3000 | 30 | 1 | Pd | 8700 | 7 | 1.00 | 3.8 | 430 | ○ |
| Example 21 | 580 | 30 | 1 | Cu | 1700 | 7 | 1.00 | 6.5 | 400 | ○ |
| Example 22 | 580 | 30 | 1 | W | 1700 | 7 | 1.00 | 6.5 | 400 | ○ |
| Example 23 | 580 | 30 | 1 | Mo | 1700 | 7 | 1.00 | 6.5 | 400 | ○ |
| Example 24 | 580 | 30 | 1 | Ag | 1700 | 7 | 1.00 | 6.5 | 400 | ○ |
| Example 25 | 580 | 30 | 1 | Cu | 1700 | 7 | 1.00 | 6.5 | 400 | ○ |
| Example 26 | 580 | 30 | 1 | Ni | 1700 | 7 | 1.00 | 6.5 | 400 | ○ |
| Example 27 | 580 | 30 | 1 | Ni—Al alloy | 1700 | 7 | 1.00 | 6.5 | 400 | ○ |
| Example 28 | 580 | 30 | 1 | Pd | 1700 | 2 | 1.02 | 6.0 | 410 | ○ |
| Example 29 | 580 | 30 | 1 | Pd | 1700 | 6 | 3.05 | 5.5 | 420 | ○ |
| Example 30 | 580 | 30 | 1 | Pd | 1700 | 10 | 6.87 | 5.0 | 430 | ○ |
| Example 31 | 580 | 30 | 1 | Pd | 1700 | 2 | 1.00 | 6.3 | 400 | ○ |

Examples 15 to 18

The material for the transmission line was prepared by using the same method as in Example 1 except that particle size of the powder of metal Pd which was mixed with the material for the first dielectric was changed as shown in Table 1.

Example 19

The material for the transmission line was prepared by using the same method as in Example 1 except that the powders of $BaTiO_3$, $SrTiO_3$ and MnO were weighed with Examples 21 to 27

The metallic element mixed with the material for the first dielectric changed as shown in Table 1. The material for the transmission line was prepared by using the same method as in Example 1 except that $Li_2O$ was added as a proper sintering additive when the material for the first dielectric was mixed with the metallic powder, the temperature during the thermal treatment to provide the sintered body of the line portion was adjusted between 900° C. and 1400° C., and the thermal treatment, when the sintered body of the line portion was to be provided, was performed properly under air or a mixed gas atmosphere composed of nitrogen and oxygen.

Example 28

The material for the transmission line was prepared by using the same method as in Example 1 except that the magnetic dielectric was obtained as the material for the second dielectric in the preparation method as shown below. In particular, the powder of permalloy with an average particle size of 0.3 μm was used as the metallic magnetic powder, and the polycycloolefin resin was added as the resin varnish to make the content of the metallic magnetic powder became 3 vol %. The mixture was mixed in a high-speed planetary mixer (the orbital speed was 2000 rpm and the rotating velocity was 800 rpm) for 5 minutes to provide a mixture being magnetic as the material for the second dielectric.

Example 29

The material for the transmission line was prepared by using the same method as in Example 1 except that the magnetic dielectric was obtained as the material for the second dielectric in the preparation method as shown below.

In particular, the powder of permalloy with an average particle size of 0.3 μm was used as the metallic magnetic powder, and the polycycloolefin resin was added as the resin varnish to make the content of the metallic magnetic powder became 20 vol %. The mixture was mixed in a high-speed planetary mixer (the orbital speed was 2000 rpm and the rotating velocity was 800 rpm) for 5 minutes to provide a mixture being magnetic as the material for the second dielectric.

Example 30

The material for the transmission line was prepared by using the same method as in Example 1 except that the magnetic dielectric was obtained as the material for the second dielectric in the preparation method as shown below.

In particular, the powder of permalloy with an average particle size of 0.3 μm was used as the metallic magnetic powder, and the polycycloolefin resin was added as the resin varnish to make the content of the metallic magnetic powder became 40 vol %. The mixture was mixed in a high-speed planetary mixer (the orbital speed was 2000 rpm and the rotating velocity was 800 rpm) for 5 minutes to provide a mixture being magnetic as the material for the second dielectric.

Example 31

The material for the transmission line was prepared by using the same method as in Example 1 except that the magnetic dielectric was obtained as the material for the second dielectric in the preparation method as shown below.

In particular, only the polycycloolefin resin was mixed in a high-speed planetary mixer (the orbital speed was 2000 rpm and the rotating velocity was 800 rpm) for 5 minutes to provide the material for the second dielectric.

<Assessment>

The relative permittivity and the relative permeability of the obtained first dielectric, the second dielectric and the sintered body of the line portion were calculated, and the results were listed in Table 1. In addition, the obtained material for transmission line was used to form the transmission line and the electronic components into shapes as shown in FIG. 1. The resonant frequency and the unloaded Q value were respectively measured, and the results were recorded in Table 1.

[Measurement on Dielectric Properties]

The dielectric properties of the dielectric in the present embodiment were measured according to "the method for testing dielectric properties of fine ceramics for microwave", Japanese Industrial Standards (JIS R1627, 1996).

As for the assessment of the dielectric properties, the resonant frequency $f_o$ was obtained by Hakki-Coleman method (a method involving dielectric resonate with both ends short-circuited). Then, the relative permittivity was calculated based on the size of the fired body (sintered body) and $f_o$.

[Measurement on Magnetic Properties]

In the measurement of the relative permeability, a tabular test sheet of 6 mm×6 mm×0.8 mm was used. In addition, a network analyzer (HP8753D, prepared by Agilent Technologies) and an ultrahigh frequency band permeability measurement apparatus (PMF-300, prepared by Ryowa Electronics Co. Ltd) were used in the measurement.

[Resonant Frequency and Unloaded Q Value when Transmission Line and Electronic Component were Formed into Shapes]

As shown in FIG. 1, an electronic component 1 of the present embodiment contained a dielectric line 2 of the present embodiment. The transmission line 2 was provided with a line portion 10 and a surrounding dielectric portion 20, wherein the line portion 10 had a first relative permittivity and was composed of a first dielectric and a conductor filler dispersed in the first dielectric, and the surrounding dielectric portion was composed of a second dielectric having a second relative permittivity. The material for the transmission line obtained in the foregoing examples was used to form such a shape. The resonant frequency and the unloaded Q value were respectively measured and then recorded in Table 1. In Table 1, an unloaded Q value of 300 was used in comparison to determine whether the unloaded Q value was good or not, wherein, the unloaded Q value of 300 was obtained when a conductor electrode made of the metal Ag itself was used in a conventional transmission line in the line portion 10. The result was recorded.

It could be seen from Table 1 that each of Examples 1 to 27 was within the scope of the present invention so that the resonant frequency went into the range of 1 GHz to 10 GHz. The unloaded Q value was larger than the Q value of 300 which was obtained when a conductor electrode made of metal Ag was used in the line portion and a great skin effect was provided.

It can be seen from the result of Comparative Example 1 that the relative permittivity of the line portion E1 was as low as 580 and the resonant frequency of 12 GHz went beyond the range of 1 GHz to 10 GHz when no conductor filler was mixed and the sintered body of the line portion made of dielectric only was used. In addition, the unloaded Q value was 290 which was lower than the Q value of 300 obtained when a conductor electrode made of the metal Ag was used in the line portion.

It can be seen from Examples 1, 2 and 3 that the unloaded Q value could be even larger when the relative permittivity of the second dielectric was one tenth of the relative permittivity of the line portion or even smaller.

It can be seen from Examples 1 and 4 to 14 that when the percentage by volume of the conductor filler in the line portion was 4% or more, the relative permittivity of the line portion E1 was larger than the relative permittivity of the first dielectric. In addition, the unloaded Q value became larger and an evident effect was provided.

Further, when the percentage by volume of the conductor filler in the line portion was 74% or less, the unloaded Q value became larger.

Based on Examples 1 and 15 to 18, it was known that when the size of the conductor filler in the line portion was 5 μm or less, the influence brought by the skin effect was inhibited to the minimum and the unloaded Q value became larger.

It could be seen from Examples 1, 19 and 20 that the resonant frequency went within the range of 1 GHz to 10 GHz and the unloaded Q value was larger than the Q value of 300 obtained when a conductor electrode made of metal Ag was used in the line portion even if the material was changed for the first dielectric.

It can be known from Examples 1 and 21 to 27 that the resonant frequency went within the range of 1 GHz to 10 GHz and the unloaded Q value was larger than the Q value of 300 obtained when a conductor electrode made of metal Ag was used in the line portion even if the metallic element was changed for the conductor filler in the line portion.

Based on the results of Examples 28, 29, 30 and 31, it was known that the unloaded Q value became larger when the second dielectric was magnetic and the relative permeability was 1.02 or more.

DESCRIPTION OF REFERENCE NUMERALS

1 electronic component
2 transmission line
10 line portion
20 surrounding dielectric portion

What is claimed is:

1. A transmission line, comprising:

a line portion with a first relative permittivity of 600 or more, the line portion being composed of a first dielectric and a conductor filler dispersed in the first dielectric; and a surrounding dielectric portion composed of a second dielectric with a second relative permittivity that is one tenth the first permittivity or smaller, the surrounding dielectric portion being disposed around the line portion in a cross section perpendicular to a direction that electromagnetic waves transmit in the line portion.

2. The transmission line of claim 1, wherein the line portion transmits electromagnetic waves of at least one frequency ranging from 1 GHz to 10 GHz.

3. The transmission line of claim 1, wherein a percentage of the conductor filler dispersed in the first dielectric is 4 to 74% by volume of an entirety of the line portion.

4. The transmission line of claim 1, wherein a size of the conductor filler dispersed in the first dielectric is 5 μm or less.

5. An electronic component comprising the transmission line of claim 1.

6. The transmission line of claim 1, wherein the surrounding dielectric portion has a relative permeability of 1.02 or more.

7. An electronic component comprising a resonator, wherein the resonator has a resonant frequency ranging from 1 GHz to 10 GHz, and the resonator is formed by using the transmission line of claim 1.

8. A transmission line, comprising:

a line portion with a first relative permittivity of 600 or more, the line portion being composed of a first dielectric and a conductor filler dispersed in the first dielectric; and a surrounding dielectric portion composed of a second dielectric with a second relative permittivity, the surrounding dielectric portion being disposed around the line portion in a cross section perpendicular to a direction that electromagnetic waves transmit in the line portion, the surrounding dielectric portion having a relative permeability of 1.02 or more.

9. The transmission line of claim 8, wherein the second permittivity is one tenth the first relative permittivity or smaller.

10. The transmission line of claim 8, wherein the line portion transmits electromagnetic waves of at least one frequency ranging from 1 GHz to 10 GHz.

11. The transmission line of claim 8, wherein a percentage of the conductor filler dispersed in the first dielectric is 4 to 74% by volume of an entirety of the line portion.

12. The transmission line of claim 8, wherein a size of the conductor filler dispersed in the first dielectric is 5 μm or less.

13. An electronic component comprising the transmission line of claim 8.

14. An electronic component comprising a resonator, wherein the resonator has a resonant frequency ranging from 1 GHz to 10 GHz, and the resonator is formed by using the transmission line of claim 8.

15. An electronic component comprising a resonator, wherein the resonator has a resonant frequency ranging from 1 GHz to 10 GHz, and the resonator is formed by using a transmission line comprising:

a line portion with a first relative permittivity of 600 or more, the line portion being composed of a first dielectric and a conductor filler dispersed in the first dielectric; and a surrounding dielectric portion composed of a second dielectric with a second relative permittivity, the surrounding dielectric portion being disposed around the line portion in a cross section perpendicular to a direction that electromagnetic waves transmit in the line portion.

16. The electronic component of claim 15, wherein the second permittivity is one tenth the first relative permittivity or smaller.

17. The electronic component of claim 15, wherein the line portion transmits electromagnetic waves of at least one frequency ranging from 1 GHz to 10 GHz.

18. The electronic component of claim 15, wherein a percentage of the conductor filler dispersed in the first dielectric is 4 to 74% by volume of an entirety of the line portion.

19. The electronic component of claim 15, wherein a size of the conductor filler dispersed in the first dielectric is 5 μm or less.

20. The electronic component of claim 15, wherein the surrounding dielectric portion has a relative permeability of 1.02 or more.

* * * * *